United States Patent [19]

Adachi et al.

[11] 4,173,164

[45] Nov. 6, 1979

[54] ELECTRONIC MUSICAL INSTRUMENT WITH FREQUENCY MODULATION OF A TONE SIGNAL WITH AN AUDIBLE FREQUENCY SIGNAL

[75] Inventors: Takeshi Adachi; Masahiko Koike; Toshiyuki Takahashi, all of Hamamatsu, Japan

[73] Assignee: Nippon Gakki Seizo Kabushiki Kaisha, Shizuoka, Japan

[21] Appl. No.: 909,370

[22] Filed: May 25, 1978

[30] Foreign Application Priority Data

| | | | |
|---|---|---|---|
| Jun. 1, 1977 | [JP] | Japan | 52-64157 |
| Dec. 13, 1977 | [JP] | Japan | 52-148846 |
| Dec. 21, 1977 | [JP] | Japan | 52-154099 |

[51] Int. Cl.[2] ..... G10H 1/04; G10H 5/00

[52] U.S. Cl. ..... 84/1.19; 84/1.24; 84/DIG. 8

[58] Field of Search ..... 84/1.11, 1.12, 1.19, 84/1.21, 1.22, 1.23, 1.24, 1.25, DIG. 8

[56] References Cited

U.S. PATENT DOCUMENTS

| | | | |
|---|---|---|---|
| 3,716,647 | 2/1973 | Kameoka et al. | 84/1.11 |
| 3,794,748 | 2/1974 | Deutsch | 84/1.24 |
| 3,847,050 | 11/1974 | Freeman | 84/1.25 |
| 3,882,751 | 5/1975 | Tomisawa et al. | 84/1.11 X |
| 3,886,836 | 6/1975 | Hiyoshi | 84/1.19 X |
| 3,956,961 | 5/1976 | Peterson | 84/1.24 |
| 4,018,121 | 4/1977 | Chowning | 84/1.24 X |

FOREIGN PATENT DOCUMENTS

| | | | |
|---|---|---|---|
| 50-10117 | 2/1975 | Japan | 84/1.25 |

*Primary Examiner*—Stanley J. Witkowski

*Attorney, Agent, or Firm*—Frishauf, Holtz, Goodman & Woodward

[57] ABSTRACT

An electronic musical instrument comprises first and second voltage-controlled frequency-variable oscillators responsive to application of a pitch determining voltage signal from a keyboard circuit to produce first and second audible frequency signals, respectively. The second audible frequency signal is coupled to the first voltage-controlled oscillator to produce a frequency-modulated tone signal to be sounded in which the first audible frequency signal is frequency-modulated with the second audible frequency signal. The content of harmonic components in a musical tone can be increased by sideband components resulting from frequency modulation. The second audible frequency signal may be amplitude-controlled to be proportional, in amplitude, to the magnitude of pitch determining voltage signal, amplitude-modulated with a time-varying control waveform, and/or waveform-modified to provide desirable modulation effects. The mixture of the pitch determining voltage signal and the second audible frequency signal may be coupled to the first voltage-controlled oscillator through an absolute value circuit. The second audible frequency signal may be also coupled to a sound system together with the frequency-modulated tone signal.

11 Claims, 9 Drawing Figures

ELECTRONIC MUSICAL INSTRUMENT WITH FREQUENCY MODULATION OF A TONE SIGNAL WITH AN AUDIBLE FREQUENCY SIGNAL

BACKGROUND OF THE INVENTION

This invention relates to an electronic musical instrument and, more particularly, to a music synthesizer type electronic musical instrument utilizing frequency modulation of a tone signal with an audible frequency signal to enhance tonal effect of musical tones sounded.

Recently, music synthesizer type electronic musical instruments have been widely used by music players which incorporate a voltage-controlled tone signal synthesizing circuit arrangement including a voltage-controlled frequency-variable oscillator, voltage-controlled cutoff-frequency-variable filter, voltage-controlled gain-variable amplifier and time varying control waveform generators coupled to the voltage-controlled oscillator, filter and amplifier. The tone pitch, tone color and envelope of a musical tone being produced are controlled in accordance with the respective time-carrying control waveforms. Thus, such music synthesizer type electronic musical instruments are considerably effective to produce musical tones rich in variation as compared to conventional ordinary electronic musical instrument. However, in the musical synthesizer type electronic musical instruments, since a restricted number of waveforms of tone signals are used, the tone color of musical tones produced tends to be monotonous. This is because the harmonic content of musical tones is not satisfactorily great.

SUMMARY OF THE INVENTION

It is an object of this invention to provide an improved music synthesizer type electronic musical instrument with means for effectively increasing the harmonic content of musical sounds produced.

In accordance with this invention, first and second voltage-controlled frequency-variable oscillators are provided which are coupled to a keyboard circuit to receive a pitch determining voltage signal therefrom and arranged to produce first and second audible frequency signals, respectively. At least the first audible frequency signal is utilized as a tone signal to be sounded which corresponds to the note of a depressed key at the keyboard circuit, and the second audible frequency signal is coupled as a modulation signal to the first voltage-controlled oscillator together with the pitch determining voltage signal to thereby produce a frequency-modulated tone signal therefrom in which the first audible frequency signal is frequency-modulated with the second audible frequency signal.

A relatively large number of sideband components are produced by frequency modulation of the first audible frequency signal with the second audible frequency signal so that the harmonic content of musical tones can be effectively increased and thus pleasant musical tones rich in tone color are produced. This invention has various features as described below.

A level adjustor is provided at the input of the second voltage-controlled oscillator for adjusting the level of a pitch determining signal applied thereto so that a music player can arbitrarily alter the sideband structure of FM spectrum.

A waveform modifier is provided between the second voltage-controlled oscillator and the first voltage-controlled oscillator for modifying the second audible frequency signal or modulation signal having a symmetrical waveform so that the waveform of the modulation signal becomes asymmetrical. As a result of provision of the waveform modifier, symmetrical upper and lower cent deviations (in musical scale) of a frequency-modulated signal with respect to a carrier frequency or fundamental tone pitch depending on the magnitude of a pitch determining voltage signal are obtained, resulting in a modulation effect desired in the equally tempered musical scale.

An amplitude controller is provided for making the amplitude of modulation signal proportional to the magnitude of pitch determining voltage signal so that the modulation index of frequency modulation becomes substantially uniform over the overall compass of an electronic musical instrument.

An amplitude modulator is provided for amplitude-modulating a modulation signal with a time-varying waveform signal so that the frequency spectrum of frequency modulation varies with time.

An absolute value circuit is provided at the input of the first voltage-controlled oscillator for folding a level of the mixture of the pitch determining voltage signal and a modulation signal which is below an operation threshold level of the first voltage-controlled oscillator back to a level above the operation threshold level. By the absolute value circuit, inoperation of the first voltage-controlled oscillator which might occur when the modulation index is relatively large can be prevented.

DESCRIPTION OF THE PREFERRED EMBODIMENTS

Figure 1:
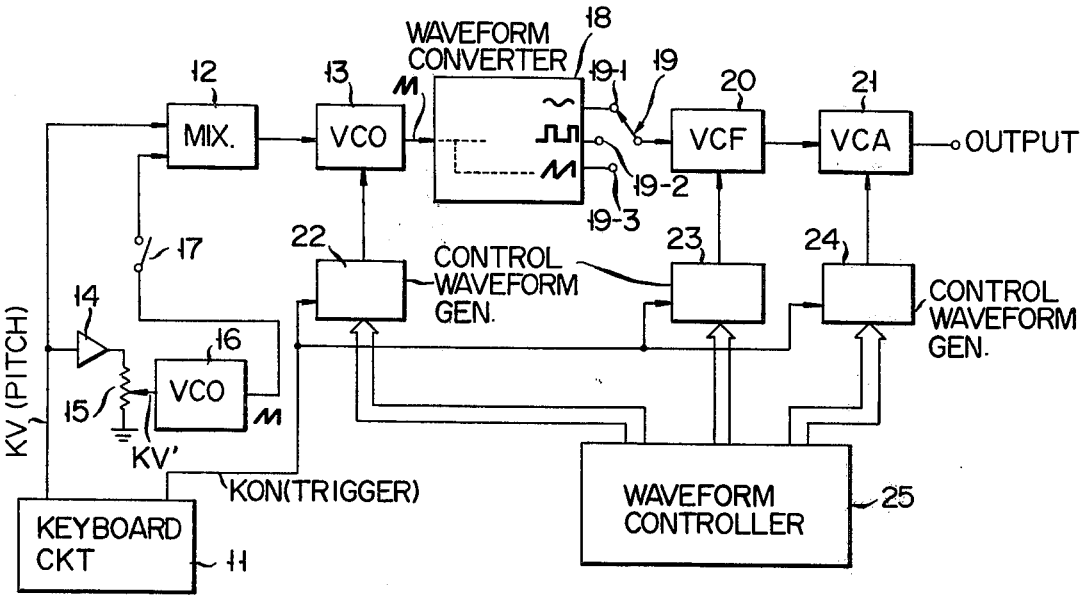
FIG. 1 is a schematic block diagram of an electronic musical instrument according to an embodiment of this invention.
Figure 3:
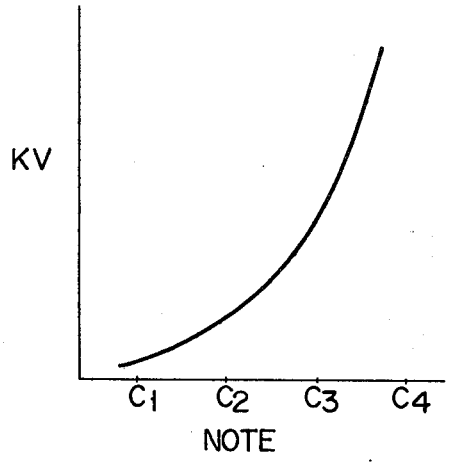
FIG. 3 shows a relation between a pitch determining voltage signal from the keyboard circuit and key note.

In FIG. 1 showing an embodiment of this invention, reference numeral 11 designates a known keyboard circuit which provides, during a period of time from key depression to key release, a pitch determining voltage signal (hereinafter referred to as KV signal) whose magnitude is a function of the note of a depressed key, and key depression representative signal or trigger signal (hereinafter referred to as KON signal). The relation between the magnitude of KV signal and the key note is shown in FIG. 3 and the magnitude of KV signal is defined by an exponential function of key note in view of the equally tempered musical scale.

The KV signal from the keyboard circuit 11 is coupled through a mixer 12 to a first voltage-controlled frequency-variable oscillator (hereinafter referred to as VCO) 13 utilized as a tone generator to produce a tone signal or first audible frequency signal corresponding to the note of a depressed key. The VCO 13 is arranged such that its output frequency is proportional to the magnitude of a KV signal applied thereto. The KV signal is further coupled through a buffer amplifier 14 to one end of the resistance body of a manually operable potentiometer 15, the other end of the resistance body being connected to ground. The slider of potentiometer 15 is coupled to the input of a second VCO 16 acting as a modulation signal generator. An output signal of VCO 16 is applied through a switch 17 to the mixer 12 where it is mixed with the KV signal to be in turn applied to VCO 13. The VCO 16 may be of the same structure as VCO 13 and, in this invention, the VCO 16 generates an audible frequency signal like VCO 13. The VCO's 13 and 16 may be of such a type as to generate sawtooth waves as shown. The buffer amplifier 14 may be arranged so as to have a gain slightly higher than unity, for example, two at most. When the buffer amplifier has a gain of two, the VCO 16 can generate an arbitrary frequency depending on the magnitude of an input voltage signal KV' determined by a slider position of potentiometer 15 and ranging from a frequency an octave above the output frequency $f_1$ of VCO 13 depending on the magnitude of KV signal from keyboard circuit 11 to zero frequency obtained when the slider of potentiometer 15 is at ground potential.

The VCO 13 is responsive to the mixture of the KV signal from keyboard circuit 11 and the modulation signal from VCO 16 to produce a frequency-modulated (FM) signal in which a carrier signal of a frequency $f_1$ depending on the magnitude of KV signal is frequency-modulated with the modulation signal of $f_2$.

Assuming that the carrier signal and modulation signal both are of the sinusoidal wave, the resultant FM spectrum consists, as is well known, of a carrier frequency ($f_1$) line and a number of sideband lines at frequencies $f_1 \pm nf_2$, n being the order of a sideband component. When $f_1 = f_2$, overtones are composed which are exactly harmonically related to the carrier frequency. When $f_1 \neq f_2$, an inharmonic spectrum is realized in which sideband components are not harmonically related to the carrier. It will be evident that, when the carrier signal and/or modulation signal is of a complex waveform such as sawtooth wave, a considerably complicated FM spectrum is realized as compared to the case where only sinusoidal waves are used. In this invention, since KV signal is coupled to the modulation signal generator 16 as well as the carrier signal generator 13, it is possible to generate a modulation signal appropriate to a carrier frequency. Namely, an automatic modulation-frequency control is performed.

It will be understood that, by virtue of FM modulation scheme in which the carrier frequency and modulation frequency are both in the audible frequency range, the harmonic content of musical tones sounded can be effectively increased and thus musical tones rich in tone color are produced. Further the present electronic musical instrument enables a music player to select a desired sideband structure of FM spectrum by adjustment of the potentiometer 15. With a conventional electronic musical instrument which is intended only to use a tone signal with a complex waveform to produce a musical tone, the above-mentioned inharmonic frequency spectrum cannot be realized.

The output of VCO 13 is coupled through a waveform converter 18 and a waveform selection switch 19 to a voltage-controlled cutoff-frequency-variable filter (VCF) 20 and voltage-controlled gain-variable amplifier (VCA) 21 in turn. The output of VCA 21 is coupled to a sound system (not shown) including a suitable amplifier and a loudspeaker. Though, in the figure, the waveform converter 18 has a sinusoidal wave providing output terminal 19-1, a rectangular wave providing output terminal 19-2 and a sawtooth wave providing terminal 19-3 connected to the output of VCO 13, the kind and number of waveforms used need not be restricted as such.

To the VCO 13, VCF 20 and VCA 21 are respectively coupled time-varying control waveforms from control waveform generators 22, 23 and 24 which are triggered by the KON signal from the keyboard circuit 11 to produce the control waveforms having, as is well known, controllable parameters such as an attack time, attack level, first decay time, sustain level, and second decay time. A manually operable waveform controller 25 is provided to couple parameter control voltage signals to the respective control waveform generators in order for a player to alter the shape of the respective time-varying control waveforms at his will.

Figure 2:
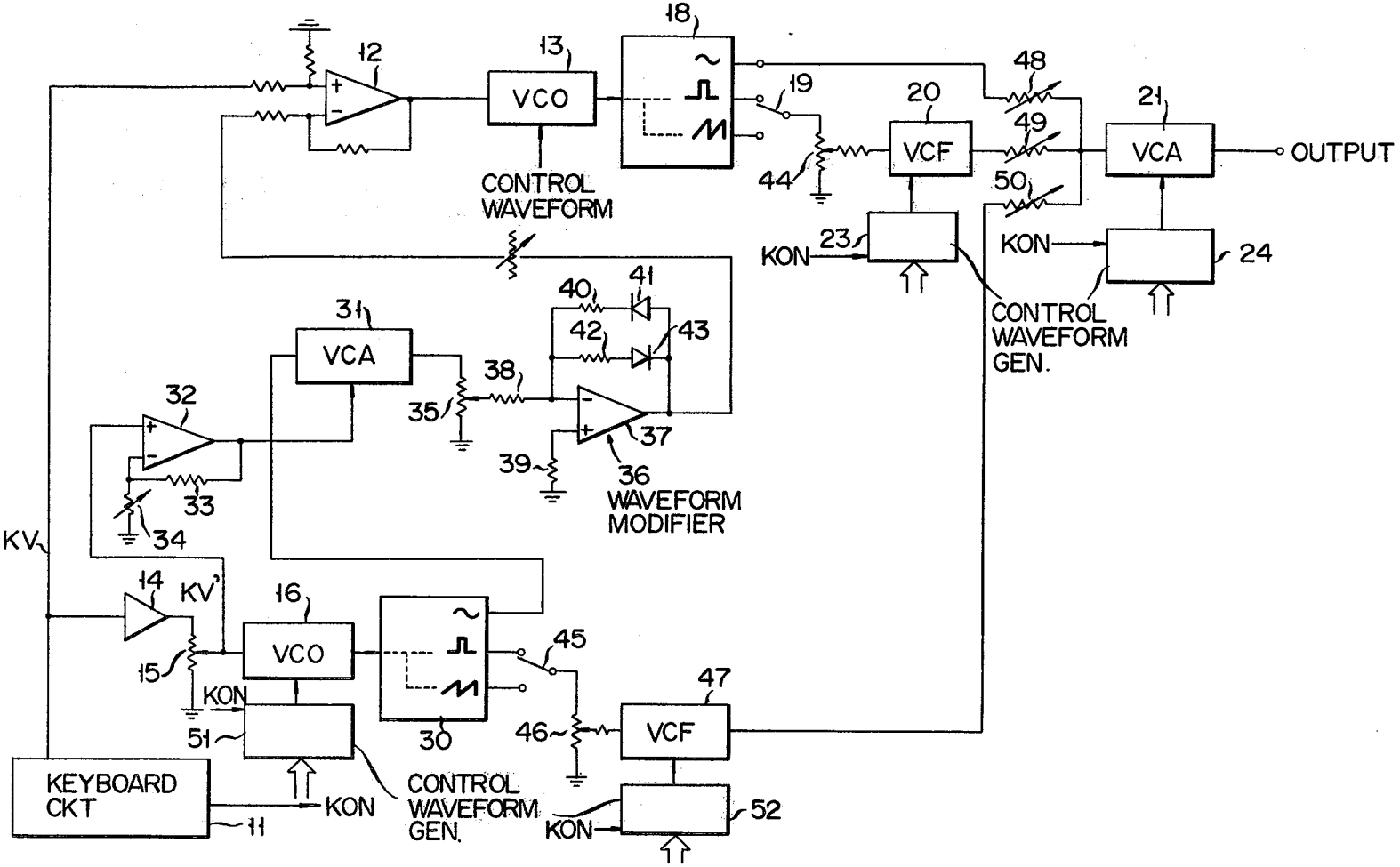
FIG. 2 is a block diagram according to another embodiment of this invention.

FIG. 2 shows another embodiment of this invention, the same parts as those of FIG. 1 being designated by like numerals. The embodiment is characterized primarily in that the modulation signal produced by VCO 16 and applied to VCO 13 is subject to automatic amplitude control and waveform modification, and that the modulation signal is also used as a tone signal to be sounded.

A waveform converter 30 is connected to the output of VCO 16. The waveform converter 30 may be so arranged, like the waveform converter 18 connected to the VCO 13, to provide a sinusoidal wave, rectangular wave and sawtooth wave. In this embodiment, a sinusoidal wave signal having a symmetrical waveform is used as a modulation signal. The sinusoidal wave modulation signal is coupled to an input of a multiplier or amplitude controller 31 which may be constituted by VCA. The input voltage signal KV' of VCO 16 is also coupled to the noninverting input of an operational amplifier 32. A resistor 33 is connected between the output and the inverting input of operational amplifier 32, the inverting input being connected to ground through a variable resistor 34. The output voltage of operational amplifier 32 is coupled to a control input of VCA 31 and can be controlled by adjustment of the variable resistor 34.

The VCA 31 is arranged to multiply an input signal having a constant amplitude irrespective of its frequency by the control voltage applied thereto so that the amplitude of output signal therefrom is made proportional to the magnitude of control voltage. Since the control voltage has such a characteristic as shown in FIG. 3, the amplitude of output signal from VCA 31 is also defined by an exponential function of key note. In other words, the modulation signal is made proportional, in amplitude, to the magnitude of KV or KV' signal.

The provision of amplitude controller 31 is based on the following reason. As described above, the amplitude of modulation signal from VCO 16 or waveform converter 30 does not vary from note to note. However, the frequency of modulation signal varies from note to note. Accordingly, it is evident that the modulation index of FM modulation which is proportional to a ratio of the modulation amplitude to the modulation frequency varies from note to note. Specifically, the modulation index in the high compass is smaller than that in the low compass. As described above, however, since the frequency of modulation signal is proportional to the magnitude of KV' signal and the amplitude of modulation signal is also proportional to the magnitude of KV' signal due to provision of VCA 31, the modulation index does not vary from note to note. The modulation index for each note varies with the slider position of the potentiometer 15, but it is desired that, in a music expression, the modulation index not vary from note to note with the slider of potentiometer 15 set at the same position.

The output of VCA 13 is coupled to the inverting input of operational amplifier or mixer 12 through a level adjuster 35 and waveform modifier 36. The KV signal from the keyboard circuit 11 is coupled to the noninverting input of the operational amplifier 12. The waveform modifier 36 is comprised of an operational amplifier 37 having its inverting input coupled to the slider of level adjuster 35 through a resistor 38 and its noninverting input coupled to ground through a resistor 39, a first series combination of a resistor 40 and a diode 41 and a second series combination of a resistor 42 and a diode 43, the first and second series combinations being connected between the output and inverting input of operational amplifier 37. The diodes 41 and 43 are arranged in the opposite directions with respect to each other as shown.

The waveform modifier 36 is particularly effective when the modulation signal is of a symmetrical waveform such as sinusoidal wave and is arranged to modify the modulation signal such that its waveform becomes asymmetrical with respect to the reference level.

When a sinusoidal wave modulation signal with a completely symmetrical waveform is applied to the VCO 13, upper and lower absolute frequency deviations from carrier signal for each note corresponding to the positive and negative peaks of modulation signal are symmetrical with respect to the carrier frequency. However, upper and lower cent deviations in terms of the equally tempered musical scale are asymmetrical with respect to the carrier frequency. The upper cent deviation corresponding to the positive peak of modulation signal is defined by $100\times\log_2(fc+\Delta f)/fc$, and the lower cent deviation corresponding to the negative peak of modulation signal by $100\times\log_2(fc-\Delta f)/fc$, where fc is a carrier frequency and $\Delta f$ is an absolute frequency deviation. For example, when fc=100 Hz, $\Delta f$=50 Hz, the frequency of frequency-modulated carrier corresponding to the positive peak of modulation signal is 150 Hz and, on the other hand, the frequency of frequency-modulated carrier corresponding to the negative peak of modulation signal is 50 Hz. That is, the frequency of frequency-modulated carrier corresponding to the negative peak of modulation signal is an octave below the carrier frequency, but the frequency of frequency-modulated signal corresponding to the positive peak of modulation signal is not an octave above the carrier frequency. Therefore, it will be understood that the symmetrical positive and negative frequency deviations are asymmetrical in terms of the equally tempered musical scale, not desirable in music expression.

In this invention, the modulation signal with symmetrical waveform is so modified as to have an asymmetrical waveform with a result that substantially symmetrical cent deviations can be expected. In the waveform modifier 36, the resistors 38, 40 and 42 are selected to have values of $R_1$, $R_2$ and $R_3$, respectively. Specifically, the resistors 40 and 42 are selected to have unequal values, for example, 5 KΩ and 10 KΩ, respectively.

Figure 4A:
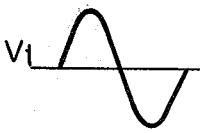
FIGS. 4A to 4C are waveform diagrams useful in explaining of the operation of the waveform modifier of FIG. 2.

The input signal $V_1$ to the operational amplifier 37 is of symmetrical waveform as shown in FIG. 4A. When $V_1 \geqq 0$, the diode 43 conducts so that the output voltage $V_2$ will be:

$$V_2=-(R_3/R_1)V_1$$

When $V_1<0$, the diode 41 conducts and the output voltage $V_2$ becomes:

$$V_2=(R_2/R_1)V_1$$

Figure 4B:
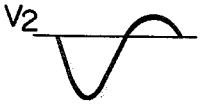
Figure 4C:
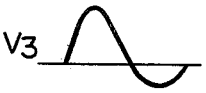

Since $R_2<R_3$, the output voltage $V_2$ is modified such that the positive half cycle is compressed relative to the negative half cycle as shown in FIG. 4B. Since the output signal of waveform modifier 36 is applied to the inverting input of operational amplifier 12, the modulation signal output of operational amplifier 12 becomes opposite, in polarity, to the input signal $V_2$ as shown in FIG. 4C.

Due to the modulation signal having its negative half cycle compressed, the positive and negative cent deviations of FM signal become substantially equal to each other. The shape of asymmetrical waveform from the waveform modifier 36 depends on values of the resistors 40 and 42. The waveform modifier 36 may be so arranged as to expand one half cycle of the input signal relative to the other half cycle.

In the embodiment of FIG. 2, one of the rectangular wave and sawtooth wave outputs of the waveform converter 18 is selected by the selection switch 19. The selected output signal is applied to VCF 20 through a level adjuster 44. Similarly one of the rectangular wave and sawtooth wave output signals from the waveform converter 30 is selected by a selection switch 45, the selected signal being coupled to VCF 47 through a level adjuster 46.

The sinusoidal wave output signal of waveform converter 18, to output signal of VCF 20 and the output signal of VCF 47 are mixed together by mixing variable resistors 48, 49 and 50 and then coupled to the VCA 21. By the mixing variable resistors 48, 49 and 50, the tone signals can be mixed together in an arbitrary ratio at player's will so that musical tones rich in variation are sounded. Control waveform generators 51 and 52 may be coupled to VCO 16 and VCF 47 to provide them with time-varying control waveform signals, respectively. These control waveform generators 51 and 52 are also triggered by the KON signal from the keyboard circuit 11 like the control waveform generators 22, 23 and 24. Thus, at the VCO 16, the modulation signal is frequency-modulated with the time-varying control waveform signal so that the frequencies of sideband components resulting from FM modulation by mixer 12 and VCO 13 is caused to vary with time in accordance with the shape of time-varying control waveform from the control waveform generator 51. In other words, the FM spectrum varies with time in frequencies of sideband components so that sounded tones are enriched in tone color variation.

Figure 5:
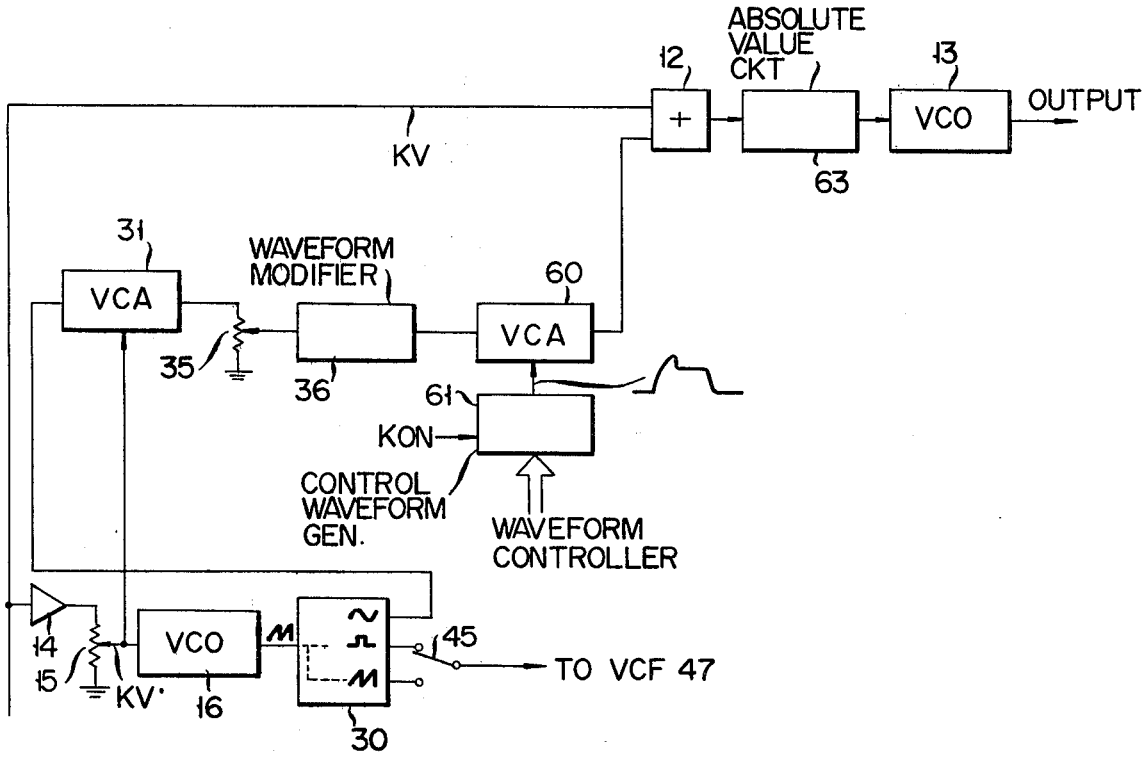
FIG. 5 is a block diagram according to still another embodiment of this invention.

FIG. 5 shows still another embodiment of this invention. This embodiment is characterized by provision of an amplitude envelope control means or amplitude modulator for the modulation signal, and an absolute value circuit for the mixture of KV signal and modulation signal. The same parts as those of FIGS. 1 and 2 are designated by like numerals and thus descriptions thereof seem unnecessary.

VCA 60 is provided at the output side of waveform modifier 36. To the VCA 60, like VCA 21 in FIGS. 1 and 2, is coupled a time-varying control waveform from a control waveform generator 61 which is triggered by the KON signal from the keyboard circuit like the control waveform generators 22, 23, to thereby amplitude-modulate the modulation signal with the time-varying control waveform signal, resulting in a modulation effect rich in variation. Namely, by virtue of VCA 60 and control waveform generator 61, the amplitudes of sideband components resulting from FM modulation by mixer 12 and VCO 13 is caused to vary with time in accordance with the shape of time-varying control waveform from the control waveform generator 61. In other words, the FM spectrum varies with time in amplitudes of sideband components so that pleasant musical tones rich in tone color variation are produced.

Figure 7:
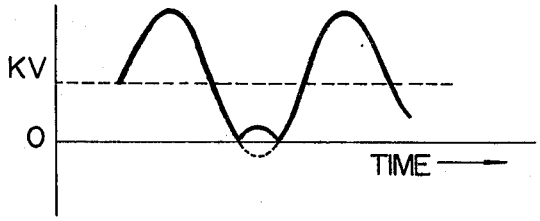
FIG. 7 is a waveform diagram useful in explaining the operation of the absolute value circuit.

VCO 13 has an operation threshold input level, for example, zero volt level, below which no oscillating operation is performed. However, the input voltage signal, i.e., the mixture of KV signal and modulation signal, to the VCO 13 might become below the operation threshold level of VCO 13 when the modulation index of FM modulation is relatively large. This might occur irrespective of provision of the above-mentioned waveform modifier 36. In FIG. 7, the waveform of input voltage signal to VCO 13 is shown in which the negative peak portion of the input voltage signal is below zero volt. The VCO 13 performs no oscillation with the portion of input voltage signal shown by a dotted line. Accordingly, in this invention, between the mining circuit 12 and VCO 13 is provided an absolute value circuit 63 for folding negative values of input voltage signal of VCO 13 back to positive values as shown in FIG. 7.

Figure 6:
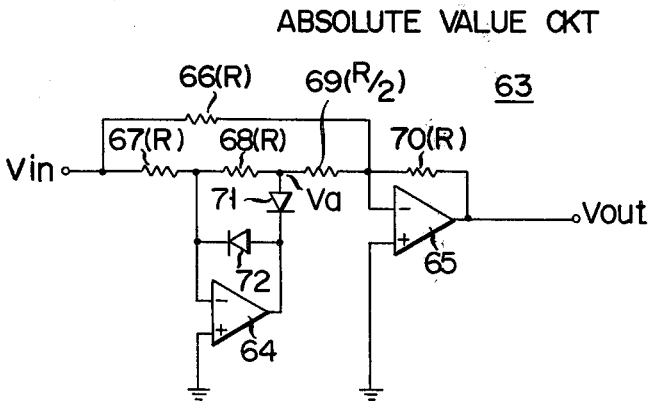
FIG. 6 is an example of the absolute value circuit of FIG. 5.

The absolute value circuit 63 may be arranged, as shown in FIG. 6, by operational amplifiers 64 and 65, resistors 66 through 70, and diodes 71 and 72. The resistors 66, 67, 68 and 70 have an equal value of R, and the resistor 69 has a value of R/2. Vin is an output voltage signal of the mixing circuit 12, i.e., the mixture of KV signal and modulation signal.

In operation of the absolute value circuit of FIG. 6, when $Vin \geqq 0$ the diode 71 is conducting and the diode 72 is not conducting.

Accordingly, $$Va = -Vin$$

$$Vout = -R(Vin/R) - (2Vin/R) - (2Vin/R) = Vin$$

When $Vin \geqq 0$, on the other hand, the diode 72 is conducting and the diode 71 is not conducting.

Hence, $$Va = 0$$

$$Vout = -R(Vin/R) = -Vin$$

As will be evident from the foregoing, the negative values of output voltage signal from the mixing circuit 12 are folded back to the positive values by the absolute value circuit 63. Due to the absolute value circuit 63 the VCO 13 is never fallen into inoperation under any value of FM modulation index.

What we claim is:

1. An electronic musical instrument comprising:

keyboard circuit means for providing a pitch determining voltage signal having a magnitude which is a function of the note of a depressed key;

first voltage-controlled frequency-variable oscillator means coupled to said keyboard circuit means to receive the pitch determining voltage signal therefrom for producing a first audible frequency signal the frequency of which corresponds to the note of the depressed key;

second voltage-controlled frequency-variable oscillator means coupled to said keyboard circuit means to receive the pitch determining voltage signal therefrom for producing a second audible frequency signal; and means for coupling the second audible frequency signal from said second voltage-controlled oscillator means to said first voltage-controlled oscillator means to thereby produce a frequency-modulated tone signal in which the first audible frequency signal is frequency-modulated with the second audible frequency signal.

2. An electronic musical instrument according to claim 1 further comprising adjusting means connected between said keyboard circuit means and said second voltage-controlled oscillator means for adjusting the magnitude of the pitch determining voltage signal applied to said second voltage-controlled oscillator means.

3. An electronic musical instrument according to claim 2 further comprising an amplifier connected between said keyboard circuit means and said adjusting means to receive the pitch determining voltage signal to be applied to said second voltage-controlled oscillator means.

4. An electronic musical instrument according to any one of claims 1 to 3 wherein said coupling means includes amplitude-control means for making the amplitude of the second audible frequency signal from said second voltage-controlled oscillator means proportional to the magnitude of pitch determining voltage signal applied to said second voltage-controlled oscillator means.

5. An electronic musical instrument according to claim 4 wherein said amplitude-control means includes a voltage-controlled amplifier.

6. An electronic musical instrument according to any one of claims 1 to 3 wherein said second voltage-controlled oscillator means is arranged to produce the second audible frequency signal having a symmetrical waveform, and said coupling means includes means for modifying the second audible frequency signal so that the symmetrical waveform of the second audible frequency signal becomes asymmetrical.

7. An electronic musical instrument according to claim 6 wherein the second audible frequency signal is of sinusoidal waveform.

8. An electronic musical instrument according to any one of claims 1 to 3 wherein said coupling means includes means for amplitude-modulating the second audible frequency signal with a time-varying control waveform signal.

9. An electronic musical instrument according to any one of claims 1 to 3 further comprising absolute value circuit means connected to an input of said first voltage-controlled oscillator means to receive the pitch determining voltage signal from said keyboard circuit means and the second audible frequency signal from said second voltage-controlled oscillator means.

10. An electronic musical instrument according to any one of claims 1 to 3 further comprising mixing means coupled to outputs of said first and second voltage-controlled oscillator means for mixing together output signals of said first and second voltage-controlled oscillator means.

11. An electronic musical instrument according to any one of claims 1 to 3 further comprising means for generating a time-varying control waveform signal which is coupled to said second voltage-controlled oscillator means to modulate the second audible frequency signal in accordance with said control waveform signal.

* * * * *